US006717566B2

(12) United States Patent
Wang

(10) Patent No.: US 6,717,566 B2
(45) Date of Patent: Apr. 6, 2004

(54) GATE LINES DRIVING CIRCUIT AND DRIVING METHOD

(75) Inventor: Chun-Fu Wang, Hsinchu Hsien (TW)

(73) Assignee: Hannstar Display Corp., Taipei (TW)

( * ) Notice: Subject to any disclaimer, the term of this patent is extended or adjusted under 35 U.S.C. 154(b) by 190 days.

(21) Appl. No.: 09/852,097

(22) Filed: May 9, 2001

(65) Prior Publication Data

US 2002/0080108 A1 Jun. 27, 2002

(30) Foreign Application Priority Data

Dec. 26, 2000 (TW) ..... 89127857 A

(51) Int. Cl.[7] ..... G09G 3/36
(52) U.S. Cl. ..... 345/103; 345/205; 345/98
(58) Field of Search ..... 345/205, 103

(56) References Cited

U.S. PATENT DOCUMENTS 4,317,115 A * 2/1982 Kawakami et al. ..... 345/94
4,770,501 A * 9/1988 Tamura et al. ..... 345/92
5,684,500 A * 11/1997 Morin et al. ..... 345/92
5,767,832 A * 6/1998 Koyama et al. ..... 345/103
6,091,390 A * 7/2000 Sim ..... 345/98
6,624,865 B2 * 9/2003 Edwards ..... 349/139

* cited by examiner

*Primary Examiner*—Steven Saras
*Assistant Examiner*—Ming-Hun Liu
(74) *Attorney, Agent, or Firm*—Thomas, Kayden, Horstemeyer & Risley

(57) ABSTRACT

The present invention provides a driving circuit and the driving method for driving gate control lines G_1 . . . G_N. The gate control lines G_1 . . . G_N are evenly divided into L groups. The driving circuit comprises a gate line control logic circuit, a first level shifter module, a second level shifter module and a multipliexer. The first level shifter module is controlled by the gate line control logic circuit, and scans the driving lines D_1 . . . D_K in each time slot to drive the driving lines one by one, wherein L*K=N. The second level shifter module is controlled by the gate line control logic circuit, and scans the L groups in each time frame to select the L groups one by one. The multiplexer is used to connect the driving lines D_1 . . . D_K to the gate control lines of a selected group, and connect the gate control lines of unselected groups to a predetermined power line.

8 Claims, 6 Drawing Sheets

GATE LINES DRIVING CIRCUIT AND DRIVING METHOD

BACKGROUND OF THE INVENTION

1. Field of the Invention

The present invention relates to a gate line driving circuit and its method, especially to the driving circuit and the method of reducing the number of level shifters needed.

2. Description of the Related Art

Liquid crystal display (LCD) panels need high voltage (at least 30V) signals to change the orientation of the liquid crystal molecules. Nevertheless, conventional logic integrated circuits (IC) are usually fabricated with a low voltage process due to lower costs and faster circuit operation speed. As a result, logic ICs need to be connected to level shifters to pull up the signals generated from the logic IC in order to control the LCD panel.

FIG. 1 is a schematic diagram of a conventional thin-film transistor(TFT) LCD and the gate line control driving circuit. The TFT LCD panel 10 comprises the following parts: (1) pixel of display 12: for transferring electric signals into optic images using materials with photo electric properties; (2) active components 14: TFT is usually adopted as the active type switch component; (3) vertical signal lines 16: for transferring image signals to the display panel; (4) horizontal signal lines: for controlling the on/off state of the switch component, also referred to as gate control lines.

The TFT LCD driving circuit 20 as shown in the left part of FIG. 1 comprises a gate line control logic circuit 22 and a plurality of level shifters 2401~240N. Each gate control line G_n has a corresponding level shifter 240*n*. Since the gate control logic circuit 22 is fabricated by low voltage IC process, the level shifters 2401–240N are fabricated by high voltage IC process on other IC chips. In IC chips, high voltage circuits need larger areas than low voltage circuits. So, if high voltage circuits can be simplified, the size of IC chips can become smaller and hence the cost can be reduced.

FIG. 2 shows a timing chart of the gate control lines of FIG. 1. As shown, the driving circuit 20 provides impulses to G_1~G_N in a time frame to select G_1~G_N one by one.

Note that in the circuit structure of FIG. 1, each gate control line must be driven with a level shifter. As the resolution of the TFT LCD increases, the number of the gate control lines is consequently increased, as is the number of the level shifters, hence resulting in the following liabilities:

(1) The size of driving IC chips (consists of a plurality of level shifters) are increased or the number of the driving IC chips is increased, as are the costs of manufacturing a driving IC and the assembly of PCB (printed circuit board);

(2) The increased cost of the driving IC will result in the increased cost of the LCD; and (3) the level shifters are used only once in each time frame, representing considerable material inefficiency.

SUMMARY OF THE INVENTION

An object of the present invention is to provide a new driving circuit for the gate control lines and a method to efficiently decrease the number of level shifters needed and consequently reduce the cost of LCD manufacture.

In order to achieve the object described, the present invention provides a driving circuit for driving a plurality of gate control lines G_1 . . . G_N for active matrix display as shown in FIG. 3. The gate control lines G_1 . . . G_N are evenly divided into L groups. The driving circuit comprises a gate line control logic circuit, a first level shifter module, a second level shifter module and a multipliexer. The first level shifter module is controlled by the gate line control logic circuit, and scans the driving lines D_1 . . . D_K in every time slot to drive the driving lines one by one, wherein L*K=N. The second level shifter module is controlled by the gate line control logic circuit, and scans the L groups in every time frame to select the L groups one by one. The multiplexer is used for connecting the driving lines D_1 . . . D_K to the gate control lines of a selected group, and connecting the gate control lines of unselected groups to a predetermined power line.

Another object of the present invention is to provide a driving method of scanning and driving a plurality of gate control lines G_1 . . . G_N. The gate control lines are evenly divided into L groups and scanned one by one in a time frame. The method comprises the following steps: (1) scanning K driving lines D_1 . . . D_K in a time slot to drive the driving lines one by one, wherein L*K=N. (2) scanning the L groups in a time frame to select the L groups one by one and to connect the gate control lines of each selected group to the driving lines D_1 . . . D_K.

The multiplexer of the present invention may be formed by active transistors, such as TFT. Therefore, the multiplexer can be produced along with the panel, without the trouble of fabricating an extra IC.

The advantage of the present invention is the reduction in level shifter quantity which consequently reduces the manufacturing cost of the LCD.

The other advantage of the present invention is that the multiplexer can be manufactured along with the display panel at no extra cost.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE PREFERRED EMBODIMENT

Figure 1:
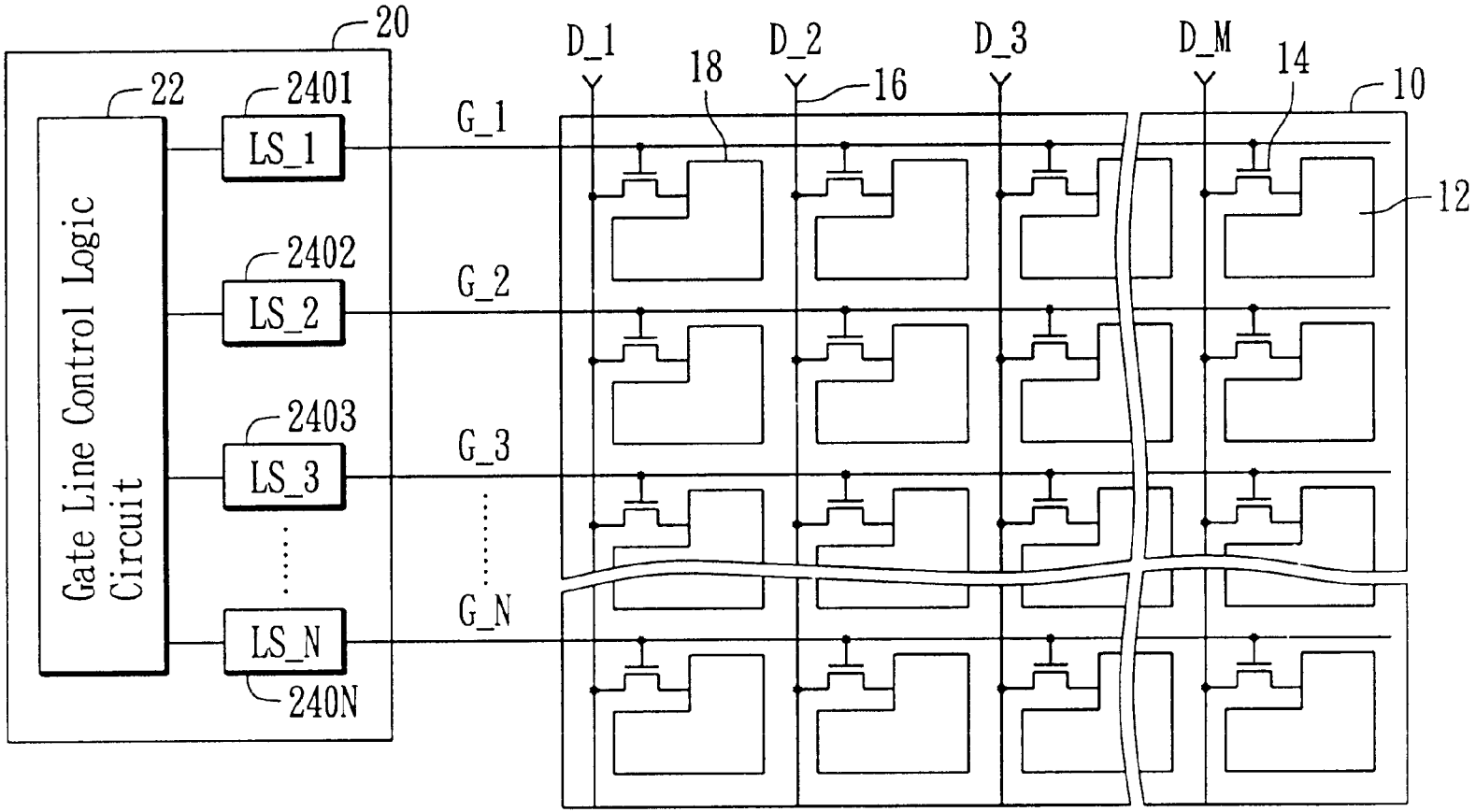
FIG. 1 (PRIOR ART)
FIG. 1 is a schematic diagram of a conventional TFT LCD and the gate line control driving circuit.
Figure 2:
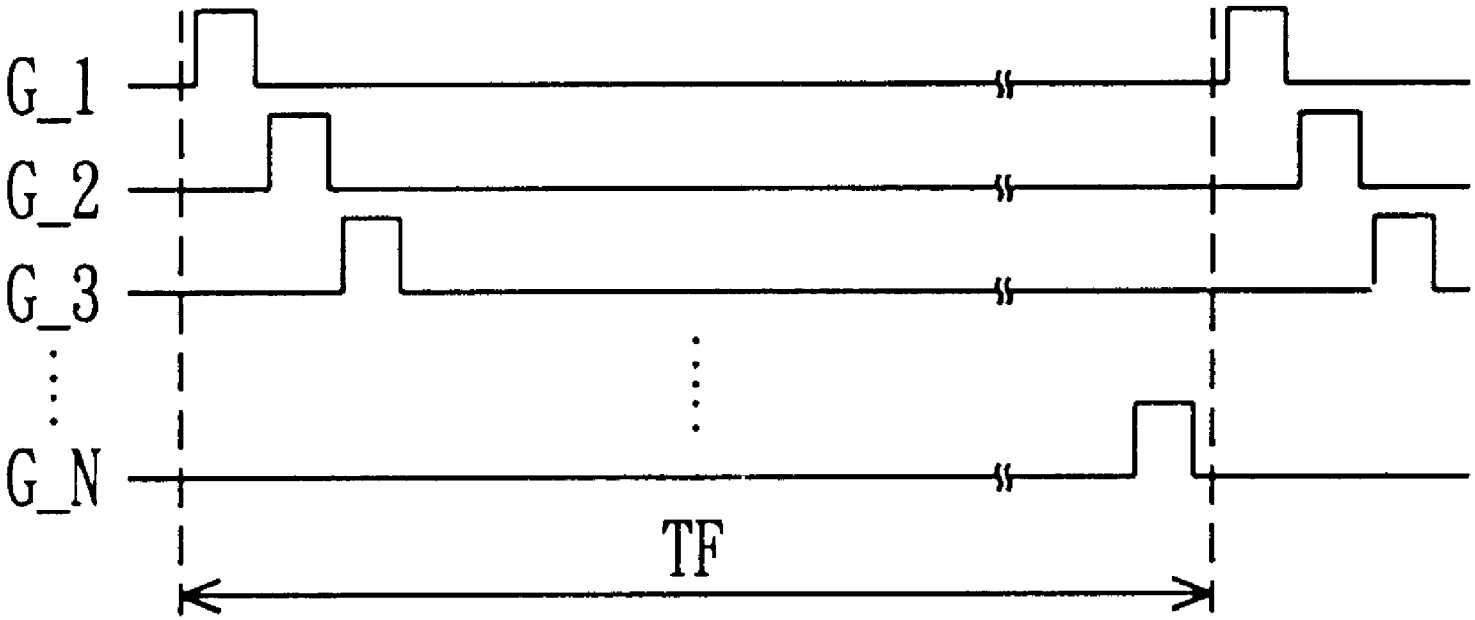
FIG. 2 (PRIOR ART)
FIG. 2 shows a timing chart of the gate control lines of FIG. 1.
Figure 3:
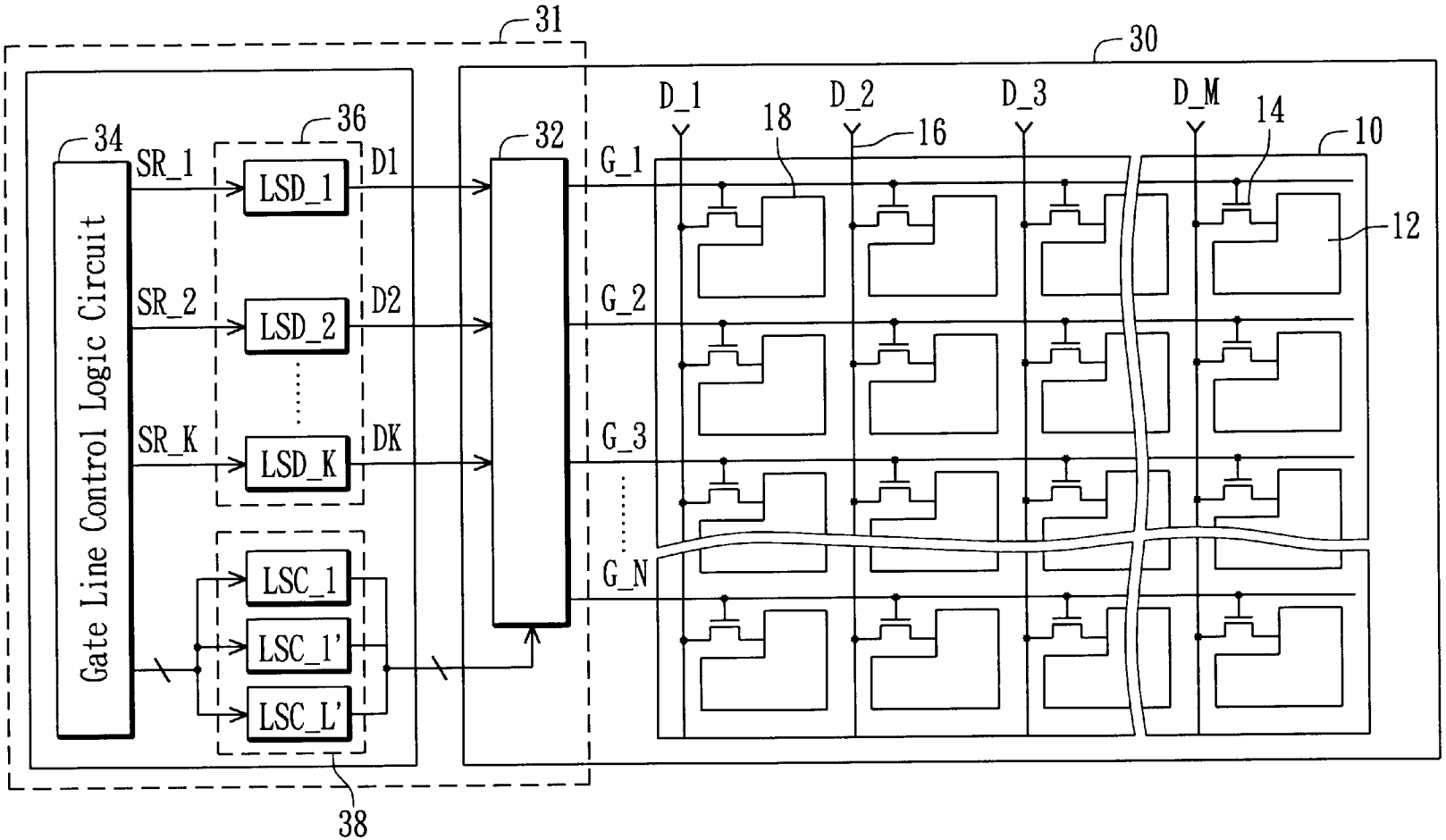
FIG. 3 shows a schematic diagram of the TFT LCD panel and the driving circuit of the present invention.

FIG. 3 is a schematic diagram of the TFT LCD panel and the driving circuit of the present invention. The display panel 30, in addition to the pixel of display 12, active component 14, vertical signal lines 16 and gate control lines G_1 . . . G_N, further comprises a multiplexer 32. The driving circuit 31 for driving gate control lines G_1 . . . G_N comprises a gate line control logic circuit 34, a first level shifter module 36, a second level shifter module 38 and the multiplexer 32 on the display panel 30.

The first level shifter module 36 consists of K level shifters LSD_1 . . . LSD_K for pulling up the scanning signals SR_1 . . . SR_K generated from the gate line control logic circuit 34 to scan and drive the K driving lines D_1 . . . D_K.

The second level shifter module 38 consists of 2*L level shifters LSC_1, LSC_1' . . . LSC_L, LSC_L' for pulling up the control signals generated in the gate control logic circuit 34. Through the selecting lines C_1 . . . C_L and the inverted selecting lines C_1' . . . C_L', the second level shifter module 38 controls the multiplexer 32. The relationship between N, K, and L is shown in equation (1):

$$N=L*K \tag{1}$$

Figure 4:
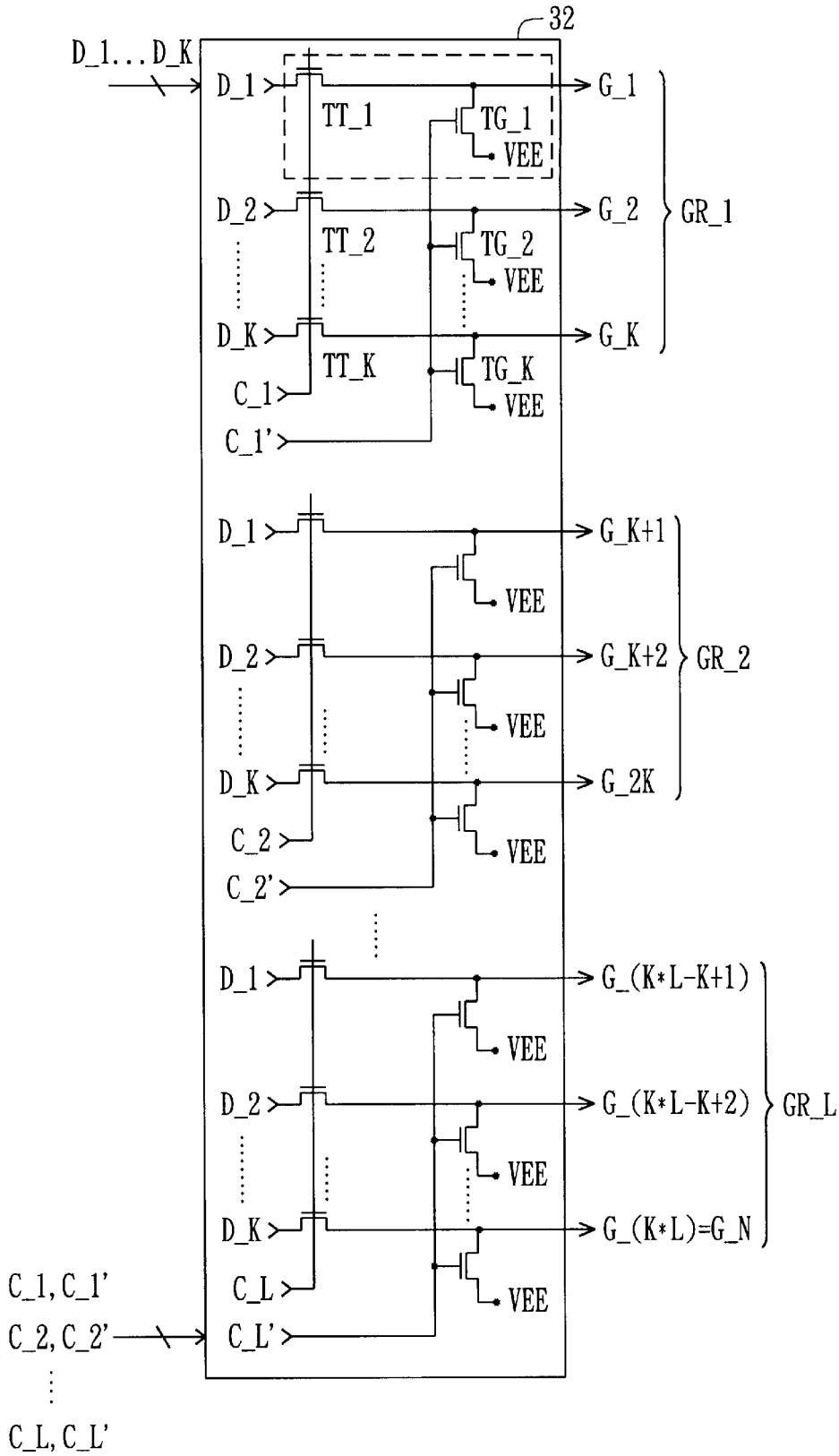
FIG. 4 is a schematic diagram of the circuit of the multiplexer in FIG. 3.

FIG. 4 is a schematic diagram of the circuit of the multiplexer in FIG. 3. The gate control lines G_1 . . . G_N are divided into L groups GR_1 . . . GR_L, wherein each group has K gate control lines. Each gate control line G_n has a corresponding transmitting TFT TT_n and a grounded TFT TG_n. The drain, source and gate of the transmitting TFT TT_n are respectively coupled to a driving line D_k, the gate control line G_n and a selecting line C_1 from the second level shifter module 38. Whereas, the drain, source and the gate of the grounded TFT TG_n are respectively coupled to the gate control line G_n, a predetermined power line VEE, and an inverted selecting line C_1', from the second level shifter module 38. The relationship between n, 1 and k is as shown in equation (2):

$$n=(1-1)*K+k \tag{2}$$

In other words, C_1, C_1' . . . C_L, C_L', each pair respectively has a corresponding group GR_1 . . . GR_L. When GR_1 is selected, C_1 has a relatively high voltage while C_1' has a relatively low voltage, and all the gate control lines G_(K*1−K+1) . . . G_(K*1) are connected to D_1 . . . D_K. And all the gate control lines in the unselected groups are connected to the power line VEE.

Notice that all the components in the multiplexer 32 in FIG. 4 are NMOS and the NMOS can be TFT. Thus it can be concluded that by merely modifying the mask pattern, the multiplexer 32 can be manufactured along with the display panel 30 without adding extra cost. Alternatively, the multiplexer 32 can be formed by high voltage IC, but the cost will be increased relatively as a result.

Figure 5:
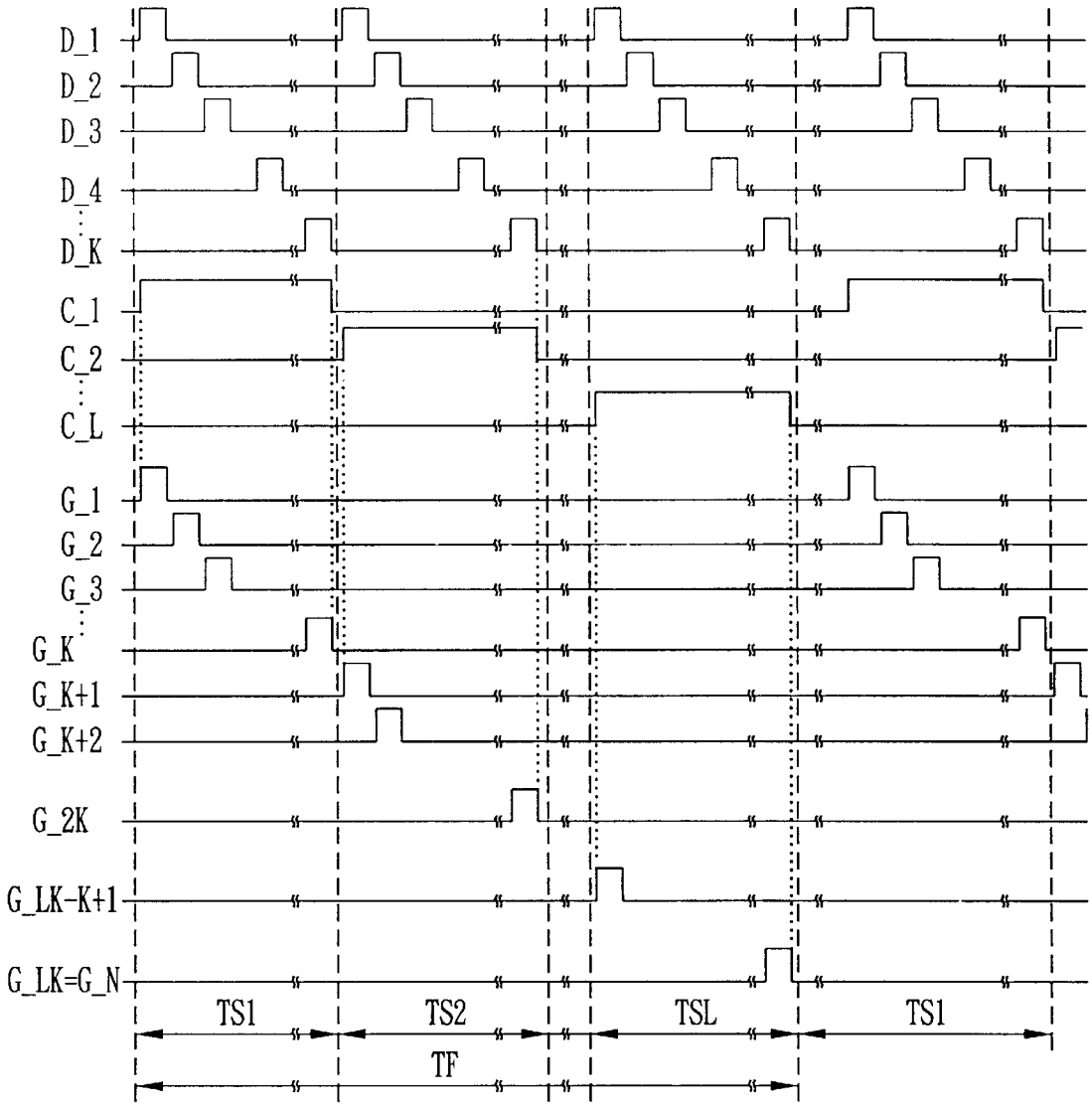
FIG. 5 is a timing diagram of the present invention.

FIG. 5 is a timing diagram of the present invention. It is assumed the time taken to scan a picture frame being a time frame TF, the time frame is divided into L time slots TS1 . . . TSL. It is provided that the driving lines D_1 . . . D_K are scanned, or driven, one by one in a time slot, and the selecting lines C_1 . . . C_L are driven one by one in a time frame. That is, in time slot TS1, only group GR_1 with a corresponding C_1 is selected. All the gate control lines in group GR_1 are connected to D_1 . . . D_K. And all the (L−1)*k gate control lines in the unselected groups are connected to the power line VEE. As described, in the time slot TS_1, the electric signals on the gate control lines G_1 . . . G_K in GR_1, controlled by C_1 and C_1', receive and follow the electric signals on D_1 . . . D_K, therefore the gate control lines G_1 . . . G_K are driven one by one. After the gate control lines in GR_1 are scanned in the first time slot TS1, the gate control lines G_K+1, G_K+2 . . . G_2K in GR_2 are then scanned in the time slot TS_2. After going though K time slots (a time frame), and all the gate control lines (G_1 . . . G_N)are scanned and driven, the next picture frame can then be displayed by repeating the scanning and driving process from groups GR_1 . . . GR_L at the next time slots.

Figure 6:
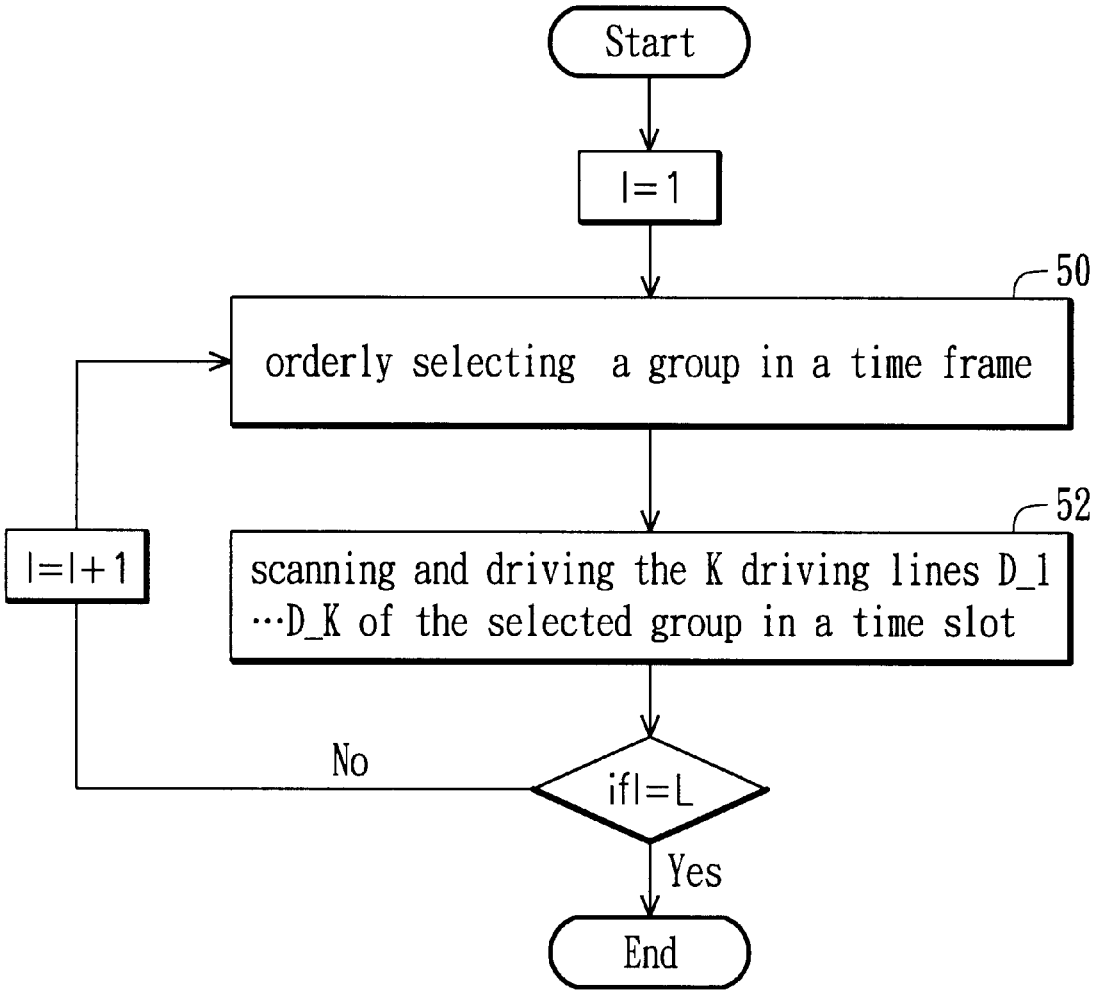
FIG. 6 is a block diagram of the driving method of the present invention.

FIG. 6 is a block diagram of the driving method of the present invention. At the start (as numeral 50), orderly selecting a group in a time frame so that the gate control lines of the selected group are connected to the driving lines D_1 . . . D_KS. Next, scanning and driving the K driving lines D_1 . . . D_K of the selected group in a time slot. All the gate control lines of the unselected groups are connected to a power line VEE.

As illustrated above, the number of level shifters used to drive the N gate control lines of the present invention S is:

$$S=2*L+K \tag{3}$$

For example, assume that N=600 (600 gate control lines), and L=6(6 groups), K=100 (=600/6). It can thus be concluded that there are only 122 (=2*6+100) level shifters needed to drive 600 gate control lines. Compared to the conventional driving circuit, the present invention reduces the number of level shifters needed to a great extent.

From the equations (1), (3) and some mathematic maneuverings, it can be concluded theoretically that when $L=(N/2)^{1/2}$, S has a minimum value $2*(2N)^{1/2}$. It is thus a better choice to have L rounded to an integer closest to $(N/2)^{1/2}$.

The driving circuit of the present invention greatly increases the utilization rate of the level shifters when driving with a fixed number of gate control lines. Fewer level shifters are used in the present invention compared with the conventional driving circuit, and the manufacturing costs can be reduced significantly. More particularly, the number of level shifters does not increase with the number of the gate control lines when higher display resolutions are needed.

Finally, while the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A driving circuit for driving N gate control lines G_1 . . . G_N for an active matrix display, wherein the gate control lines are evenly divided into L groups, the driving circuit comprising:

a gate line control logic circuit;

a first level shifter module, controlled by the gate line control logic circuit, scanning K driving lines D_1 . . . D_K in each time slot to drive the driving lines one by one, wherein L*K=N;

a second level shifter module, controlled by the gate line control logic circuit, and scanning the L groups in each time frame to select the L groups one by one; and a multiplexer for connecting the driving lines D_1 . . . D_K to the gate control lines of the selected group, and connecting the gate control lines of the other unselected groups to a predetermined power line.

2. The driving circuit as claimed in claim 1, wherein the gate control lines are formed on a display panel.

3. The driving circuit as claimed in claim 1, wherein the multiplexer and the gate control lines are formed on a display panel.

4. The driving circuit as claimed in claim 1, wherein the multiplexer consists of a plurality of active transistors.

5. The driving circuit as claimed in claim 1, wherein the first level shifter module comprises K level shifters.

6. The driving circuit as claimed in claim 1, wherein the second level shifter module comprises 2*L level shifters.

7. A driving circuit for driving N gate control lines G_1 . . . G_N for an active matrix display, wherein the gate control lines are evenly divided into L groups, the driving circuit comprising:

a gate line control logic circuit;

a first level shifter module, controlled by the gate line control logic circuit, scanning K driving lines D_1 . . . D_K in each time slot to drive the driving lines one by one, wherein L*K=N;

a second level shifter module, controlled by the gate line control logic circuit, and scanning the L groups in each time frame to select the L groups one by one; and a multiplexer for connecting the driving lines D_1 . . . D_K to the gate control lines of the selected group, and connecting the gate control lines of the other unselected groups to a predetermined power line;

wherein a gate control line G_n has a corresponding transmitting transistor and a corresponding grounded transistor, wherein the drain, source and the gate of the transmitting transistor are respectively coupled to a driving line D_k, the gate control line G_n and a selecting line C_1 from the second level shifter module, and the drain, source and the gate of the grounded transistor are respectively coupled to the gate control line G_n, the predetermined power line, and an inverted selecting line C_1', wherein n is an integer between 1 and N, k is an integer between 1 and K, and n=(l−1)*K+k.

8. The driving circuit as claimed in claim 1, wherein L is an integer closest to $(N/2)^{1/2}$.

* * * * *